United States Patent [19]

Murai et al.

[11] Patent Number: 4,572,654

[45] Date of Patent: Feb. 25, 1986

[54] IMAGE DENSITY CONTROL METHOD FOR ELECTROPHOTOGRAPHY

[75] Inventors: Kazuo Murai; Yutaka Hasegawa, both of Tokyo, Japan

[73] Assignee: Ricoh Company, Ltd., Tokyo, Japan

[21] Appl. No.: 441,359

[22] Filed: Nov. 15, 1982

[30] Foreign Application Priority Data

Nov. 17, 1981 [JP] Japan ..... 56-184289

[51] Int. Cl.[4] ..... G03G 15/00

[52] U.S. Cl. ..... 355/14 D; 118/665

[58] Field of Search ..... 355/14 C, 14 D, 14 CH, 355/14 E, 14 R; 430/30; 118/665, 664, 688–691

[56] References Cited

U.S. PATENT DOCUMENTS

| | | | |
|---|---|---|---|
| 3,876,106 | 4/1975 | Powell et al. | 355/14 D X |
| 4,183,657 | 1/1980 | Ernst et al. | 355/14 R |
| 4,248,527 | 3/1981 | Akiyama et al. | 355/14 D X |
| 4,277,162 | 7/1981 | Kasahara et al. | 355/14 R |
| 4,326,646 | 4/1982 | Lavery et al. | 355/14 C X |
| 4,372,672 | 2/1983 | Pries | 355/14 D X |
| 4,377,338 | 3/1983 | Ernst | 355/14 D |

FOREIGN PATENT DOCUMENTS

| | | | |
|---|---|---|---|
| 0033734 | 3/1977 | Japan | 355/14 D |

*Primary Examiner*—A. T. Grimley
*Assistant Examiner*—J. Pendegrass
*Attorney, Agent, or Firm*—David G. Alexander

[57] ABSTRACT

An image density control method for electrophotography which controls at least one of various image density parameters in response to values detected from different pattern areas. The image density parameters include an amount of charge deposited on a photoconductive element by a charger, bias voltage for development, toner density in a developer, amount of toner supply to a developing unit and transfer potential. At least two pattern areas having different potentials are formed on the surface of the photoconductive element by at least one of various means for forming charge patterns which include controlling the energization of the charger, controlling an illuminating lamp and projecting an image pattern. At each of the pattern areas, at least one of values associated with an image density is detected which include a surface potential of the pattern area before development, toner density of the pattern area after development, a surface potential of the pattern area after development and an image density of an area of a transferred image which corresponds to the pattern area. The value associated with an image density is compared with a predetermined value and matched with specific one of the pattern areas.

4 Claims, 13 Drawing Figures

MICROPROCESSOR
38
P14
P15
P16
P10
P11
P12
P13
X2
X1
T1
P27
P26
P25
P24
P21
P20
T0
INT
DATA
D/A
A/D
CLK
CS
Co
RS
EX2
EX1
A0
A1
A2
A0
A0
A0
Vcc1
Vcc2
36
32
32a
32b
56
52
42
58
40
54
62
60
82
DRUM SYNC PULSE
START PULSE 1/10 COPIES

| |
|---|
| Fig. 4A |
| Fig. 4B |

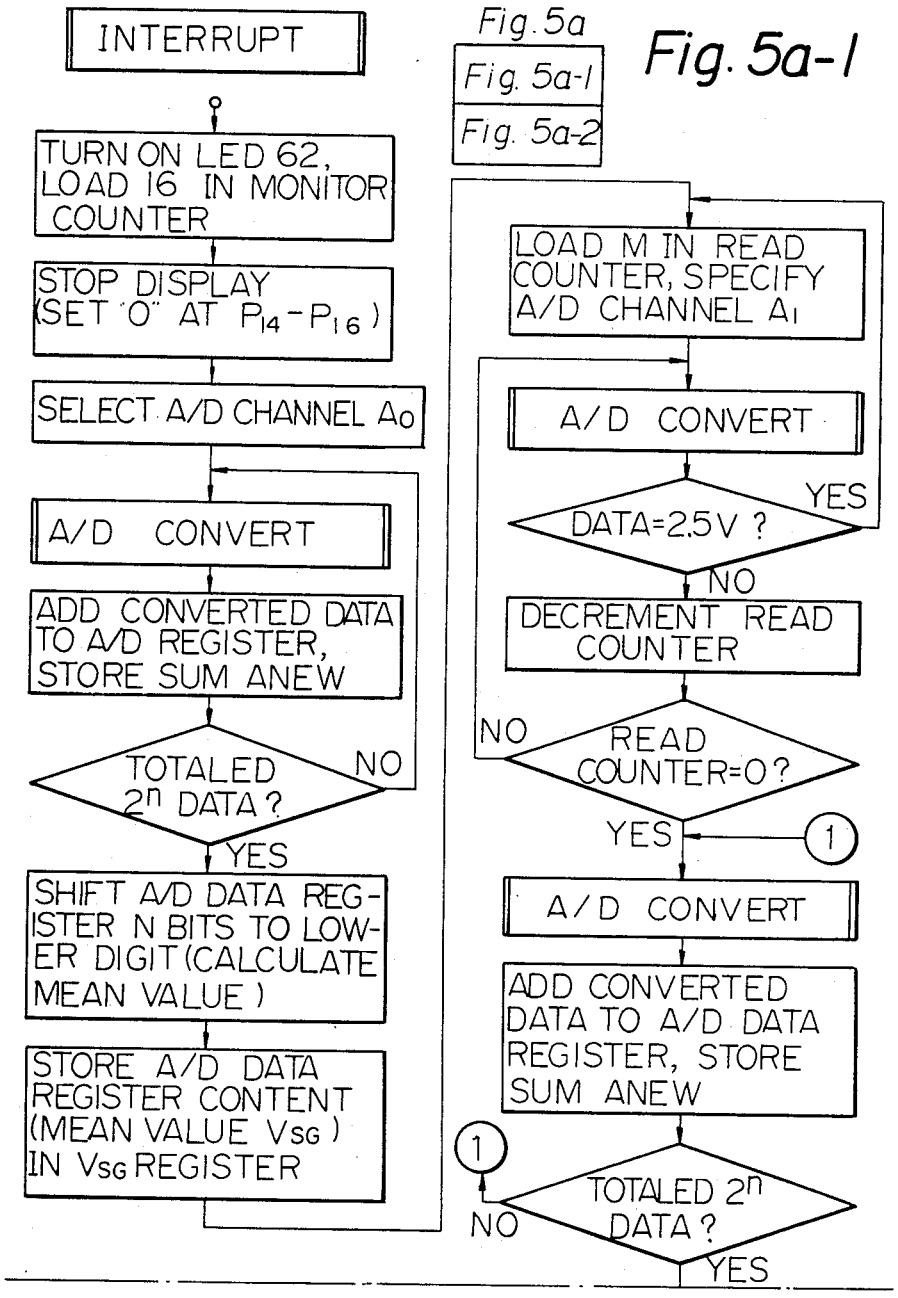
INTERRUPT
TURN ON LED 62, LOAD 16 IN MONITOR COUNTER
STOP DISPLAY (SET "0" AT P14 - P16)
SELECT A/D CHANNEL A0
A/D CONVERT
ADD CONVERTED DATA TO A/D REGISTER, STORE SUM ANEW
TOTALED 2n DATA ?
NO
YES
SHIFT A/D DATA REGISTER N BITS TO LOWER DIGIT (CALCULATE MEAN VALUE)
STORE A/D DATA REGISTER CONTENT (MEAN VALUE VSG) IN VSG REGISTER
Fig. 5a
Fig. 5a-1
Fig. 5a-2
Fig. 5a-1
LOAD M IN READ COUNTER, SPECIFY A/D CHANNEL A1
A/D CONVERT
DATA=2.5V ?
YES
NO
DECREMENT READ COUNTER
READ COUNTER=0 ?
NO
YES
1
A/D CONVERT
ADD CONVERTED DATA TO A/D DATA REGISTER, STORE SUM ANEW
1
TOTALED 2n DATA ?
NO
YES

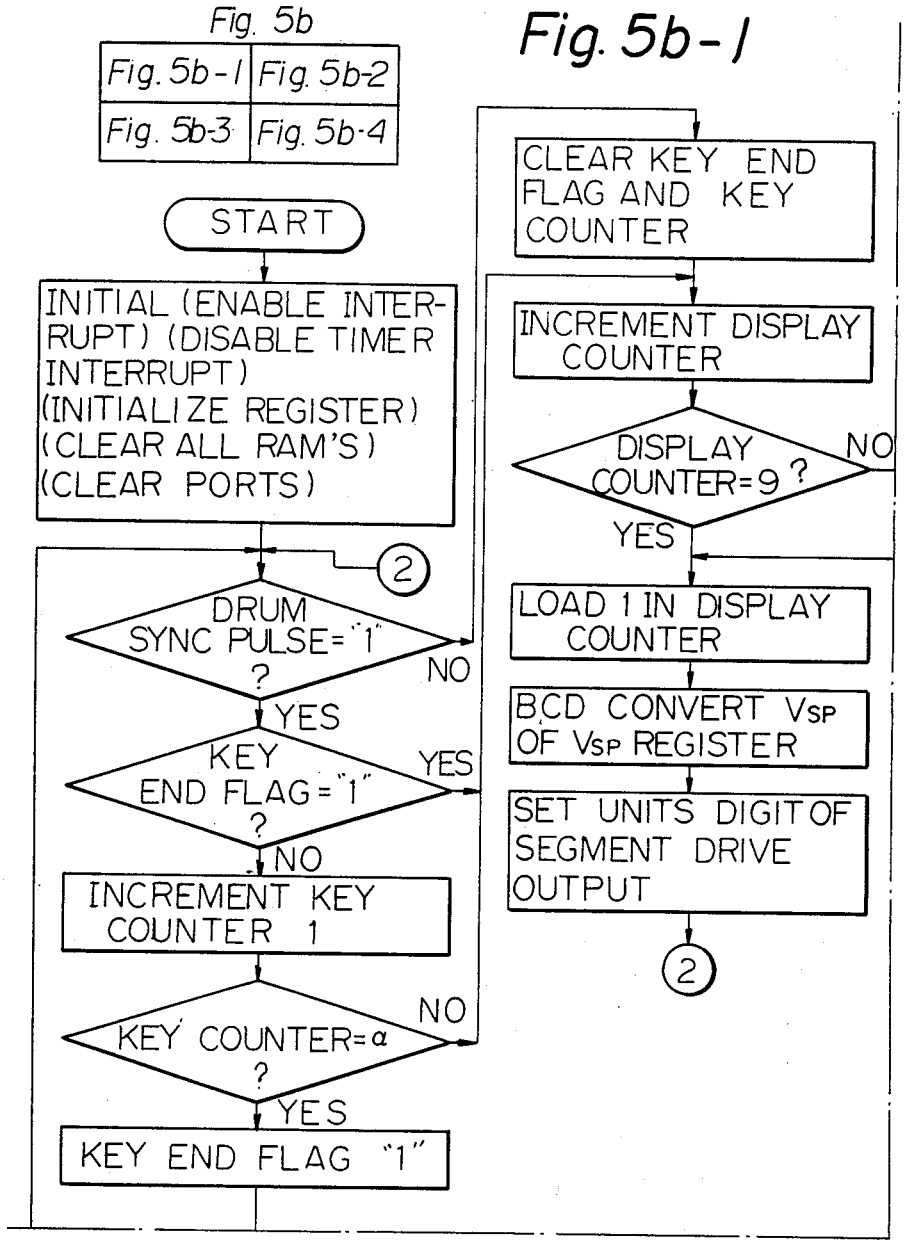
Fig. 5b
Fig. 5b-1
Fig. 5b-2
Fig. 5b-3
Fig. 5b-4
Fig. 5b-1
START
INITIAL (ENABLE INTERRUPT) (DISABLE TIMER INTERRUPT) (INITIALIZE REGISTER) (CLEAR ALL RAM'S) (CLEAR PORTS)
2
DRUM SYNC PULSE="1" ?
NO
YES
KEY END FLAG="1" ?
YES
NO
INCREMENT KEY COUNTER 1
KEY COUNTER=α ?
NO
YES
KEY END FLAG "1"
CLEAR KEY END FLAG AND KEY COUNTER
INCREMENT DISPLAY COUNTER
DISPLAY COUNTER=9 ?
NO
YES
LOAD 1 IN DISPLAY COUNTER
BCD CONVERT VSP OF VSP REGISTER
SET UNITS DIGIT OF SEGMENT DRIVE OUTPUT
2

IMAGE DENSITY CONTROL METHOD FOR ELECTROPHOTOGRAPHY

BACKGROUND OF THE INVENTION

The present invention relates to a method of controlling the density of images reproduced by an electrophotographic process and, more particularly, to an image density control method which forms at least two test patterns on a photoconductive element which have greatly different latent image potentials, detects values associated with the image densities of the two patterns or of toner images corresponding to the two patterns, and controls an image density in response to the detected values.

In an electrophotographic or electrostatic recording apparatus, a latent image is formed a electrostatically on a photoconductive element by a predetermined procedure and the latent image is developed by fine particles of colored toner supplied from a developing unit. Usually, the toner is charged to a polarity opposite to that of the latent image so that it may be electrostatically deposited on the latent image.

A method available for so charging a toner relative to a latent image employs a developer consituted by a toner and a carrier and stirs them together for frictional charging. This type of developer is usually referred to as a two-component developer. While the developing method using the two-component developer is capable of sufficiently charging a toner to a desired polarity, it requires adequate means for maintaining a constant toner concentration in the developer because only the toner is consumed by the development. It is therefore necessary to measure the varying toner concentration in the developer.

For the measurement of a toner concentration, a somewhat indirect method is known as disclosed in Japanese Patent Publication No. 16199/1968. This method comprises the steps of forming a reference latent image pattern electrostatically on a photoconductive drum, developing the reference pattern and photoelectrically measuring the density of the developed image. In a direct method heretofore proposed, on the other hand, the weight or permeability of a developer is measured. Other known methods include one which controls a toner density by detecting a surface potential of a toner image on a photoconductive element (Japanese Patent Laid Open Application No. 92138/1978).

Meanwhile various methods have also been proposed for general image density control purpose such as one which controls the bias voltage for development in accordance with a difference in reflectivity between a reference density plate and an original document (Japanese Patent Laid Open Application No. 103736/1978), one which controls the developing characteristics by detecting an image density during a copying cycle which uses a reference original document (Japanese Patent Laid Open Application No. 141645/1979), and one which controls the amount of charge on a photoconductive element, bias voltage for development and/or illumination intensity by detecting an image density on an original document, latent image potential and toner image density (U.S. Pat. No. 2,956,487).

Of these known image density control methods, those which form light and dark latent image patterns on a photoconductive drum predetermine the timings at which the light and dark pattern areas successively reach a density sensor in accordance with the movement of the photoconductive element. Timed to the start of a scan in an exposure step, pulses synchronous with the rotation of the drum begins to be counted. The density of each of the light and dark areas is read when the count of the pulses reaches a value which represent the arrival of the specific area at the density sensor. Such a method is inapplicable, however, to a copying machine which is capable of various magnifications for image reproduction, without intricate operation for matching the timings with each desired magnification. Besides, inaccuracy may exist in the relationship between the light and dark optical marks on a glass platen and the initial position of a scanning system, while their relative position may even become shifted during operation of the copier. In light of this, the arrival timings of the light and dark pattern areas at the density sensor must be determined so roughly that a substantial range of allowance may be ensured. This in turn requires the light and dark patterns to have wider areas which result in a prohibitively wide image scanning range or erase region.

SUMMARY OF THE INVENTION

An image density control method for electrophotography embodying the present invention controls at least one of various image density parameters in response to detected values of different pattern areas. The image density parameters include an amount of charge deposited on a photoconductive element by a charger, bias voltage for developement, toner density in a developer, amount of toner supply to a developing unit and transfer potential. At least two pattern areas having different potentials are formed on the surface of the photoconductive element by at least one of various means for forming charge patterns which include controlling the energization of the charger, controlling an illuminating lamp and projecting an image pattern. At each of the pattern areas, at least one of values associated with the image density is detected which include a surface potential of the pattern area before development, a toner density of the pattern area after development, surface potential of the pattern area after development, and image density of an area of a transferred image which corresponds to the pattern area. The value associated with the image density is compared with a predetermined value and matched to specific one of the pattern areas.

It is an object of the present invention to effectively control an image density in electrophotography.

It is another object of the present invention to avoid, in an image density control method for electrophotography, an increase in the pattern areas of light and dark optical marks formed on a photoconductive element while simplifying the timing for reading the pattern areas.

It is another object of the present invention to provide a generally improved image density control method for electrophotography.

Other objects, together with the foregoing, are attained in the embodiment described in the following description and illustrated in the accompanying drawings.

BRIEF DESCRIPTION OF THE DRAWINGS

FIG. 2A and 2B is a circuit diagram showing electric connection between a microprocessor and an A/D converter included in the machine of FIG. 1;

FIG. 4A and 4B is a flowchart demonstrating the operations of a copy control microprocessor for the control of constant amount toner supply and the control of toner density control command timing;

FIG. 5*a*-1 and 5*a*-2 is a flowchart demonstrating interrupt control of an image density control microprocessor;

FIG. 5*b*-1, 5*b*-2, 5*b*-3 and 5*b*-4 is a flowchart showing a main flow; and

DESCRIPTION OF THE PREFERRED EMBODIMENT

While the image density control method for electrophotography of the present invention is susceptible of numerous physical embodiments, depending upon the evironment and requirements of use, a substantial number of the herein shown and described embodiment have been made, tested and used, and all have performed in an eminently satisfactory manner.

Figure 1:
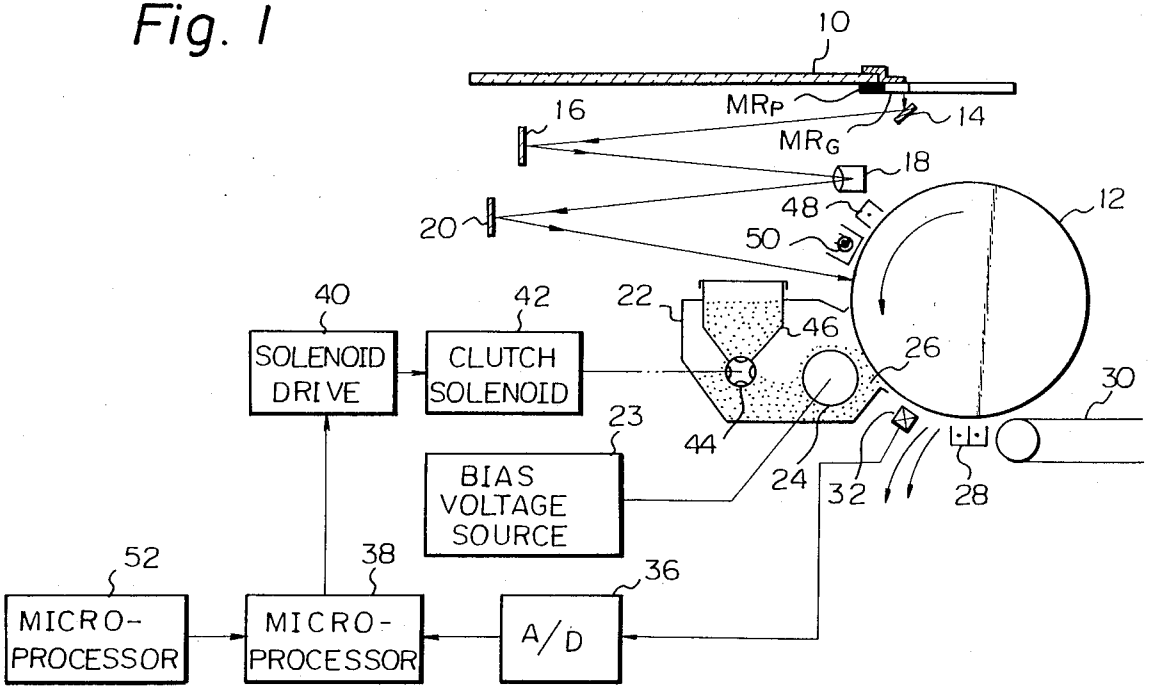
FIG. 1 is a schematic view of a copying machine furnished with a toner density control apparatus to which the present invention is applied.

Referring to FIG. 1 of the drawings, a copying machine to which the method of the present invention is applicable is shown. The copying machine includes a glass platen 10 on which an original document (not shown) is laid. Image light from the document is projected onto a photoconductive drum 12 by an imaging system which is made up of a first mirror 14, second mirror 16, in-mirror lens 18 and third mirror 20. The drum 12 is rotated counterclockwise as indicated by an arrow while the first and second mirrors 14 and 16 are moved to the left in synchronism with the rotation of the drum 12 and at a predetermined velocity ratio thereto. A latent image electrostatically formed on the drum 12 is developed by a developing unit 22 which is supplied with a bias voltage from a bias voltage source 23 and includes a roller 24 for supplying a developer 26 to the drum surface thereinside. The resulting toner image on the drum 12 is transferred onto a sheet of paper (not shown) by a transfer charger 28. The sheet carrying the toner image thereon is fed to a fixing station by a belt 30. To practice the method of the present invention in such a copier, a white optical mark $MR_G$ is carried by an edge portion of the glass platen 10 in a non-image area and in position corresponding to a home position of the first mirror 14. A black optical mark $MR_P$ is also carried by the glass platen 10 at the left of the white optical mark $MR_G$. As the first mirror 14 strokes to the left for scanning the document on the glass platen 10, pattern of the white and black marks are electrostatically and successively formed on the drum 12 as latent images. A photosensor 32 is located between the developing rolling 24 and the transfer charger 28 to sense a toner density on the surface of the drum 12. The output signal of the photosensor 32 is fed to analog-to-digital or A/D converter 36 and the digital output of the latter is fed to a microprocessor 38. The microprocessor 38 computes the density ratio between the toner image (toner image pattern) corresponding to the white mark $MR_G$ and that corresponding to the black mark $MR_P$, thereby determining an amount of toner to be supplied to the developing roller 24. For a period of time matching with the specific of toner supply, the microprocessor 38 supplies a solenoid driver 40 with a solenoid drive command so that the driver 40 energizes a clutch solenoid 42 for the duration of the solenoid drive command. Upon the energization of the solenoid 42, a roller 44 associated with a hopper 46 is coupled to a drive system for the drum 12 and thereby rotated to supply the desired amount of toner from the hopper 46.

In FIG. 1, also arranged around the drum 12 are a main charger 48 for uniformly charging the drum surface, and an erase lamp 50 for removing the charge from those areas of the drum surface just ahead and past of the image and outside a sheet size. A second microprocessor 52 is included in the illustrated copier to control copying operations other than the toner supply performed by the microprocessor 38. Because the copier employs an amount of toner supply which is predetermined in accordance with a sheet size or format, the microprocessor 38 functions to supply an amount of toner supplementary to the constant toner supply for each copy.

Figures 2, 2A, 2B:
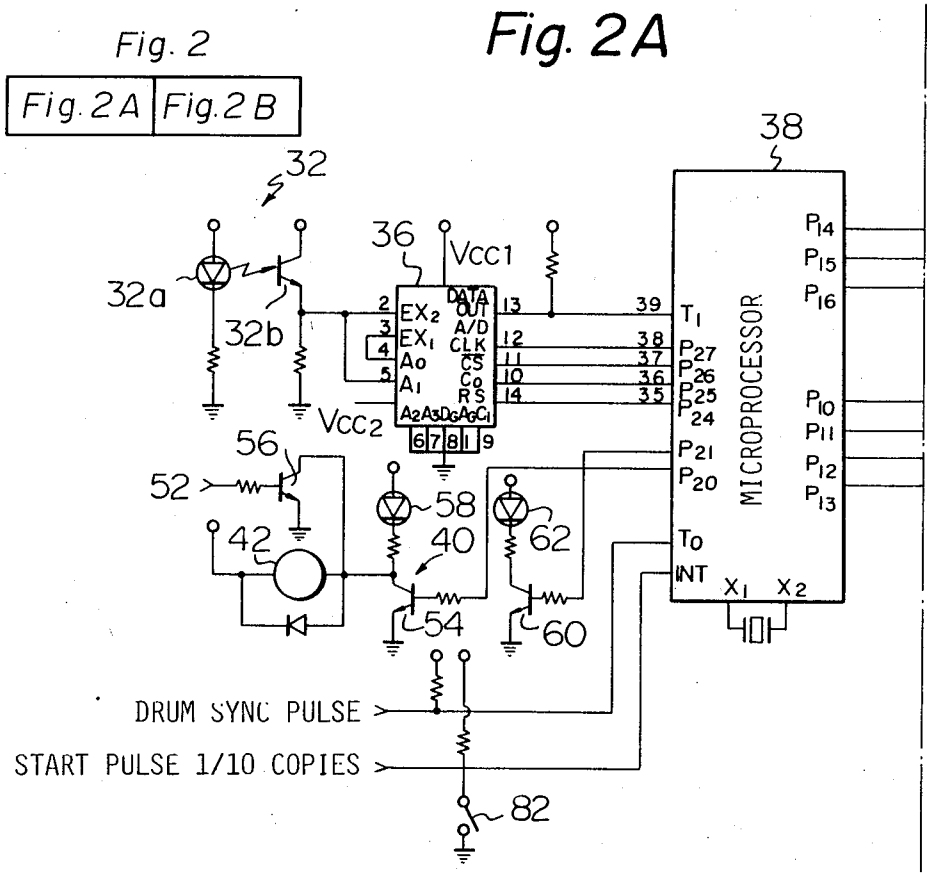
Figure 2B:
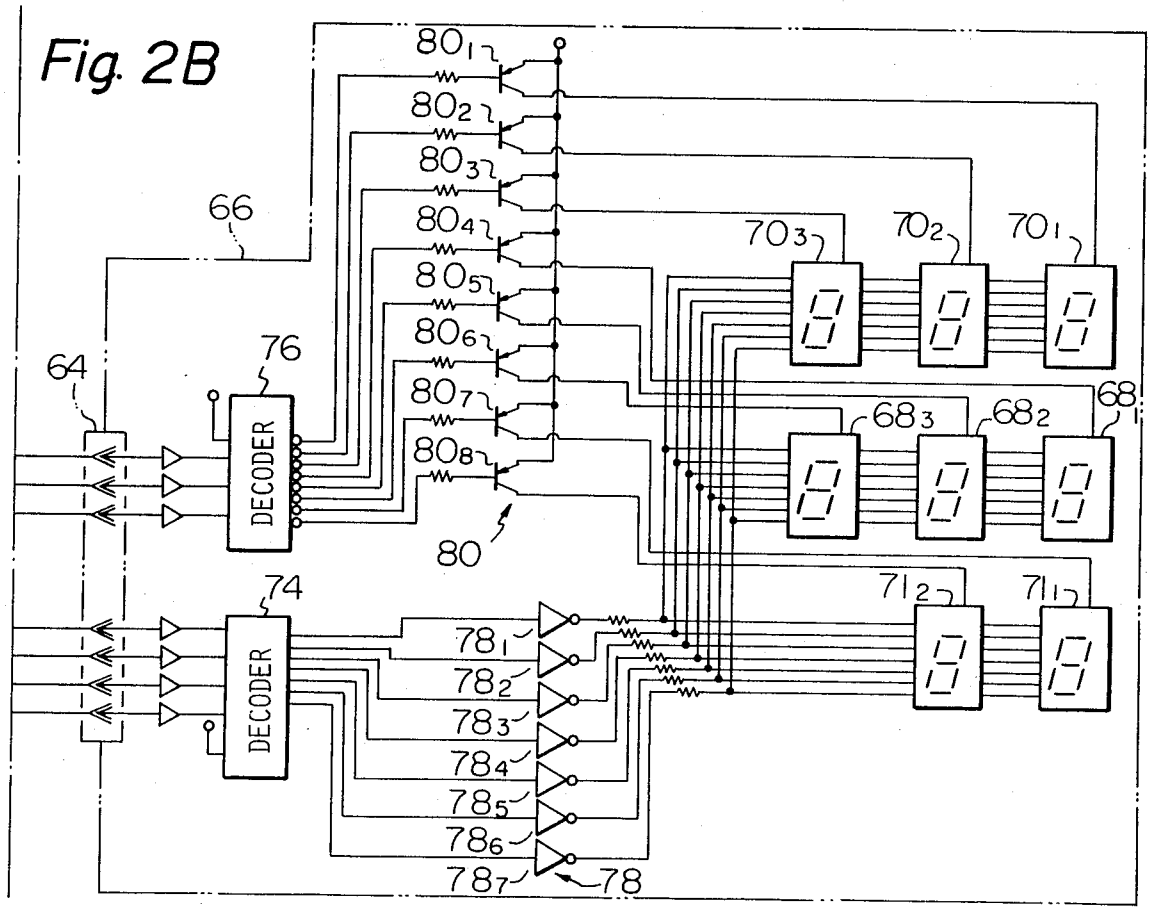

Referring to FIG. 2, the electric connection of the copier shown in FIG. 1 is illustrated in detail. The photosensor 32 comprises a light emitting diode or LED **32*a* and a phototransistor 32*b*. Light emitted from the LED 32*a* is reflected by the drum 20 and becomes incident on the phototransistor 32*b*. The emitter voltage of the phototransistor 32*b* is fed directly to an input channel $A_1$ of the A/D converter 36 (MB4025 manufactured by Fujitsu Limited, Japan) and, through voltage dividing terminals $EX_2$ and $EX_1$, to an input channel $A_0$. A digital (serial) data output terminal DATA OUT of the A/D converter 36 is connected to an interrupt terminal $T_1$ of the microprocessor 38, while control input terminals (A/D CLK-RS) thereof are connected to output ports P24-P27 of the microprocessor 38**.

Figure 3:
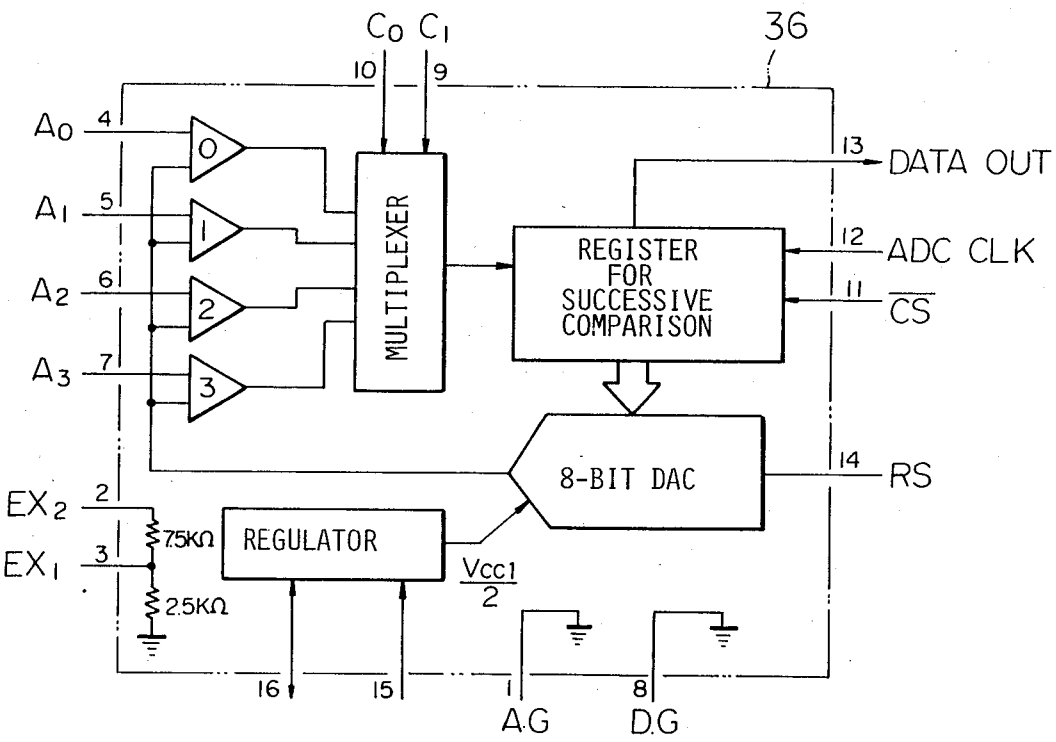
FIG. 3 is a block diagram showing details of the A/D converter indicated in FIG. 2.

The internal structure of the A/D converter 36 is shown in FIG. 3. The A/D converter 36 is of the 8-bit A/D conversion type which can be selectively supplied with input voltages $V_{cc}/2$ and $V_{cc}/8$ by range selection, while being capable of expanding the range to four times by range expansion. In a preliminary experiment, the toner density gave a voltage $V_{SG}$ of 4.0V in a drum area corresponding to the white mark $MR_G$ (background level), and a voltage $V_{SP}$ of 1.6V in a drum area corresponding to the black mark $MR_P$ (black level). For these voltage levels, the maximum voltage at the input channels $A_0$–$A_3$ is 2.5V.

Based on the data mentioned above, a measurement range of 0–10V obtained by range expansion, $V_{cc}/2\times4$, is used for the background level $V_{SG}$ and that of 0–2.5V, $V_{cc}/2$, for the black level $V_{SP}$. The emitter of the phototransistor **32*b* is connected to the terminal $EX_2$ of the A/D converter 36 while the teminal $EX_1$ is connected to the input channel $A_0$. Therefore, in A/D conversion with the input channel $A_0$ designated, the range is expanded four times as $2.5/(7.5+2.5)=\frac{1}{4}$; thus, the input channel $A_0$ is employed for the detection of the background level $V_{SG}$. The emitter of the phototransistor 32*b*** is directly connected to the input channel $A_1$ and, therefore, the input channel $A_1$ is employed for the detection of the black level $V_{SP}$. It follows that the A/D converted data of the background level $V_{SG}$ multiplied by four lies in the same range as the A/D converted data of the black level $V_{SP}$. Under this condition, the relation between the digital output n and input voltage may be expressed as:

$$V_{SG}(n)=62+(n-1)\times 39.126 \text{ mV}$$

$$V_{SP}(n)=17+(n-1)\times 9.7756 \text{ mV}$$

For example, when the background level $V_{SG}(n)$ is 103V, $V_{SG}$ (analog)$=62+102\times 39.126$ mV$=3.991$V; when the black level $V_{SP}(n)$ is 163V, $V_{SP}$ (analog)$=17+162\times 9.7756$ mV$=1.6006$V.

Referring again to FIG. 2, the solenoid driver 40 (FIG. 1) comprises a switching transistor 54 the base of which is connected to an output port $P_{20}$ of the microprocessor 38. The collector of the transistor 54 is connected to the clutch solenoid 42. When the logical level at the output port $P_{20}$ is made "1", the transistor 54 is turned on to energize the solenoid 42 so that the roller 44 (FIG. 1) associated with the hopper 46 is driven for rotation. A transistor 56 is connected to the solenoid 42 in order that a specific amount of toner supply matched to a copy size may be supplied for each copy. Thus, the toner will also be supplied when the transistor 56 is turned on under the control of the copy control microprocessor 52. While at least one of the transistors 54 and 56 is turned on, that is, during toner supply, a light emitting diode or LED 58 connected with one end of the solenoid 42 is turned on to display the toner supply. An output port $P_{21}$ of the microprocessor 38 is connected to the base of a transistor 60 which is in turn connected to a light emitting diode or LED 62 adapted for monitoring purpose. At a start of A/D conversion, the microprocessor 38 turns on the transistor 60 and thereby the monitor LED and, after a predetermined operation for setting an amount of toner supply, it turns off the transistor 60 and thereby the monitor LED 62.

An interrupt terminal INT of the microprocessor 38 is supplied from the copy control microprocessor 52 with one pulse for each set of ten copies as a toner density control command, while a power source of the copier is turned on. An interrupt terminal $T_0$ of the microprocessor 38 is supplied with a train of pulses which occur one for each predetermined small angular movement of the drum 12. The microprocessor 38 controls the amount of toner supply by counting the pulses synchronous with the rotation of the drum 12, as will be described hereinafter. Further, output ports $P_{14}$–$P_{16}$ and $P_{10}$–$P_{13}$ of the microprocessor 38 are connected to a connector 64 with which a monitor unit 66 will be connected in the event of services of the copier.

The monitor unit 66 comprises a character display $\mathbf{68_1}$–$\mathbf{68_3}$ for displaying a white level $V_{SG}$, second character display $\mathbf{70_1}$–$\mathbf{70_3}$ for displaying a black level $V_{SP}$, third character display $\mathbf{72_1}$, $\mathbf{72_2}$ for displaying a density ratio $V_{SG}/V_{SP}$, segment decoder 74, digit coder 76, segment drivers $\mathbf{78_1}$–$\mathbf{78_7}$ and digit drivers $\mathbf{80_1}$–$\mathbf{80_8}$. When the monitor unit 66 is connected with the connector 64, transient values of $V_{SG}$, $V_{SP}$ and $V_{SG}/V_{SP}$ will appear on the unit 66. The circuitry additionally includes a toner density control command switch 82 which starts a toner density control when closed temporarily and will be closed in the event of services.

Figures 4, 4A:
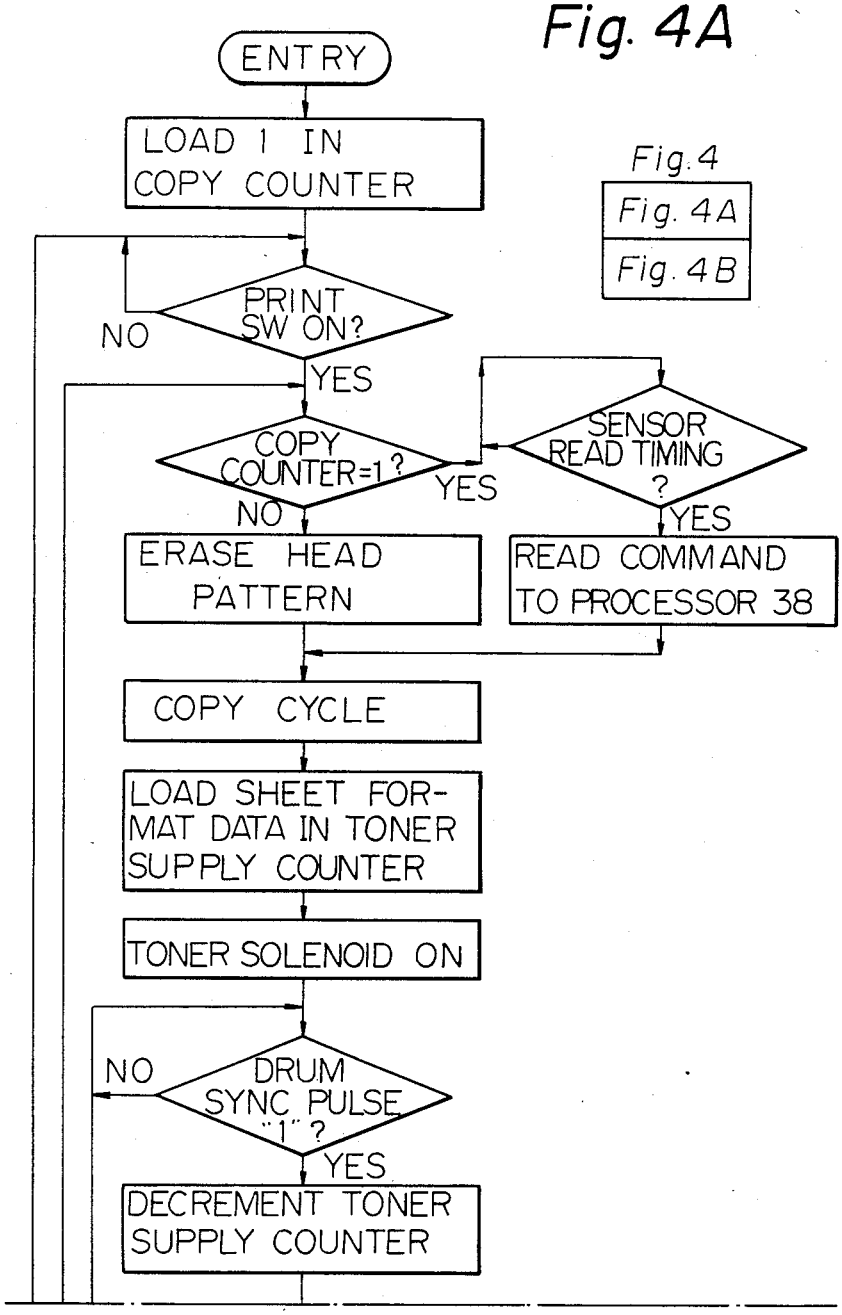
Figure 4B:
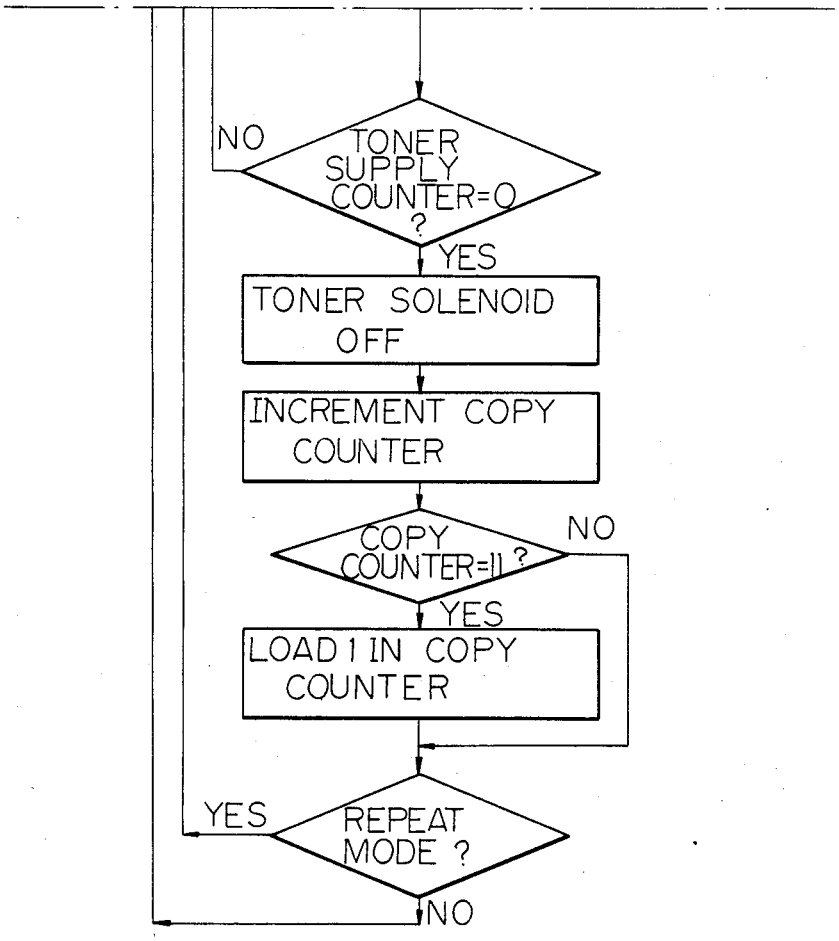

Referring to FIG. 4, a copy control flow of the microprocessor 52, particularly the constant amount toner supply, will be described. When various sections of the copier individually reach operable conditions, the microprocessor 52 loads "1" in a copy counter (program counter) which is adapted to provide a toner density control command timing. In this condition, the microprocessor 52 awaits closing of a print switch SW (not shown). As the print switch SW is closed (copy command), the charger 48 is energized to start exposure while the pulses synchronous with the drum rotation start to be counted. At the instant the pattern corresponding to the white mark $MR_G$ formed on the drum 20 reaches the sensor 32, the interrupt terminal INT of the microprocessor 38 is supplied with a toner density control command (start pulse). While the content of the copy counter is 2–10, the start pulse is not supplied and the erase lamp 50 is energized to discharge the drum surface over to the pattern corresponding to the black mark $MR_P$. Then, the copy control is continued. After one copy had been completed, a toner supplement counter (program counter) is loaded with sheet format data (toner supply time matched with a sheet format and number of pulses synchronous with the drum rotation.) At the same time, the transistor 56 (FIG. 2) is turned on. Thereafter, every time a pulse synchronous with the drum rotation arrives, the toner supplement counter is decremented by "1". Upon decrease of the counter content to "0", the transistor 56 is turned off. Then, the copy counter is incremented by "1". The microprocessor 52 starts another copying cycle in a repeat copy mode but awaits closing of the print switch SW in a single copy mode. Because the microprocessor 52 resets the copy counter to "1" each time its content reaches "11" and delivers a toner density control command to the microprocessor 38 only when the content of the copy counter is "1", a toner density control occurs once for ten successive copies.

The detection of toner densities of the patterns corresponding to the white and black marks $MR_G$ and $MR_P$, ratio calculation based on the detected toner densities and setting of a toner supply amount based on the calculated ratio are commonly carried out by an interrupt control in response to a toner density control command pulse (start pulse) fed from the microprocessor 52 to the interrupt input terminal INT. The control of the set amount of toner supply and the display drive control for the displays $\mathbf{68_1}$–$\mathbf{68_3}$, $\mathbf{70_1}$–$\mathbf{70_3}$, $\mathbf{71_1}$ and $\mathbf{71_2}$ occur according to a main routine.

Figures 2, 5A:
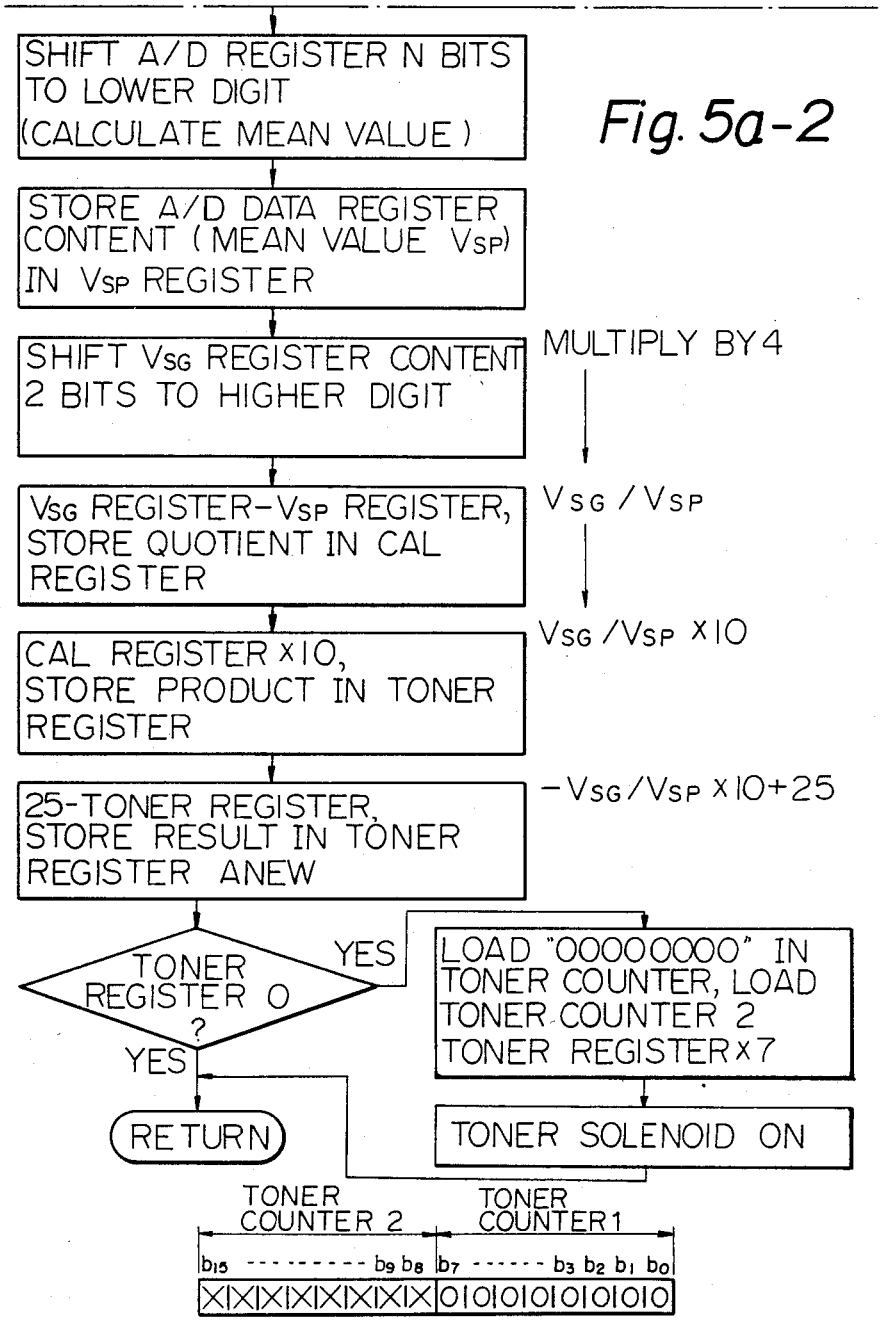

Referring to FIG. 5*a*, there is shown a flowchart which demonstrates the interrupt control. When the interrupt input terminal INT of the microprocessor 38 changes from logical "1" to logical "0" level, the microprocessor 38 makes its output port $P_{21}$ logical "1" level to energize the LED 62 and loads a monitor counter (program counter) with "16". Then, the microprocessor 38 makes its output ports $P_{10}$–$P_{13}$ and $P_{14}$–$P_{16}$ logical "0" level to turn off the indication on the displays $\mathbf{68_1}$–$\mathbf{68_3}$, $\mathbf{70_1}$–$\mathbf{70_3}$, $\mathbf{71_1}$ and $\mathbf{71_2}$, while specifying the input channel $A_0$ of the A/D converter 36. Supplying data conversion timing pulses (A/D CLK) to the A/D converter 36, the microprocessor 38 reads the A/D converted data (8 bits) serially at its port $T_1$ and stores them in addition mode in an A/D data register. After $2^n$ times of repeated A/D conversion and addition of the data, the content of the A/D register is shifted n bits to a lower digit. The resulting content of the A/D data register indicates a mean value of the $2^n$ times of A/D converted data. Because it is in response to the arrival of the toner image corresponding to the white mark $MR_G$ at the sensor 32 that the toner density control command pulse (start pulse) is fed to the interrupt input terminal INT, the A/D converted data associated with the specified input channel $A_0$ indicates a toner density of the white level ($V_{SG}$). The microprocessor 38 stores the mean value $V_{SG}$ of the white level toner density in a $V_{SG}$ register. Then, the microprocessor 38 loads a read counter (program counter) with a continuous count m for the detection of the border between the white toner pattern ($MR_G$) and the black toner pattern ($MR_P$), specifies the input channel $A_1$ for the A/D conversion, and performs A/D conversion in the same way. As already described, the input channel $A_1$ is directly supplied with a voltage indicative of a detected toner density (without voltage division), the maximum value of the input analog voltage is 2.5V, the voltage (analog) indicating a toner density of the white pattern is not lower than 2.5V, and the voltage indicating a toner density of the black pattern is lower than 2.5V. For these reasons, whether the pattern is white or black can be identified by checking whether the input voltage at the input channel $A_1$ is not lower than 2.5V (the digital data will be 2.5V when the input voltage is not lower than 2.5V, because the voltage is 2.5V in full scale). Accordingly, as long as the digital data indicates 2.5V, the microprocessor 38 determines that the sensor 32 is still detecting the white pattern and, so, repeats another A/D conversion. As the digital data indicates a voltage lower than 2.5V, the microprocessor 38 decrements the read counter by "1" and carries out A/D conversion again. When successive m times of A/D conversion have shown voltages lower than 2.5V (when the read counter has decremented to "0"), the microprocessor 38 determines that the toner image of the black pattern has been brought into the detectable range of the sensor 32, carries out $2^n$ times of A/D conversion on the voltages at the input channel $A_1$ of the A/D converter 36, and integrates them in the A/D data register.

It will be noted that, if the A/D converted data indicates 2.5V even once during (m−1) times of repeated A/D conversion after it has indicated a voltage lower than 2.5V, the microprocessor 38 loads the read counter with "m" again and repeats A/D conversion until the data continuously indicates voltages lower than 2.5V for another m times of A/D conversion.

Upon completion of the $2^n$ times of conversion and summation of the data, the microprocessor 38 shifts the content of the A/D data register by n bits to a lower digit. The resulting content of the A/D data register indicates a mean value $V_{SP}$ of the detected input voltages ($V_{SP}$). At this stage of operation, $V_{SG}$ shows a value which is $\frac{1}{4}$ of the mean value of n times of sampling of the white level, while $V_{SP}$ shows a mean value of n times of sampling of the black level. The microprocessor 38 shifts the content of the $V_{SG}$ register by two bits to an upper digit to multiply its content by four, thereby compensating the content by a proportion corresponding to the magnification in scale (four times, division of the input voltage to $\frac{1}{4}$). This makes the content of the $V_{SG}$ register common in scale to $V_{SG}$. The microprocessor 38 divides the data stored in the $V_{SG}$ register by the data stored in the $V_{SP}$ register and stores the ratio $V_{SG}/V_{SP}$ in a calculation register (CAL). Thus, the content of the calculation register indicates a density ratio $V_{SG}$ which has no relation with the scale. Subsequently, the microprocessor 38 multiplies the content of the calculation register by ten, stores the product in a toner register, subtracts the content of the toner register from "25", and stores the difference anew in the toner register. The resulting content of the toner register is $-(V_{SG}/V_{SP})\times 10+25$ the meaning of which will be described hereunder.

Preliminary experiments showed that the toner supply is unnecessary as long as reciprocal $V_{SP}/V_{SG}$ of the toner density ratio $V_{SG}/V_{SP}$ is less than 40% while, at ratios not less than 40%, one gram of toner supply is needed for an increase of each 1.7%. Table 1 shows necessary amounts of toner supply based on such results of experiments.

TABLE 1

| $V_{SP}/V_{SG}$ (%) | TONER SUPPLY (g) | $V_{SG}/V_{SP}\times 10$ |
|---|---|---|
| 40 | | 25 |
| 41.7 | 1 | 23.98 |
| 43.4 | 2 | 23.04 |
| 45.1 | 3 | 22.17 |
| 46.8 | 4 | 21.37 |
| 48.5 | 5 | 20.62 |
| 50.2 | 6 | 19.92 |
| 51.9 | 7 | 19.27 |
| 53.6 | 8 | 18.66 |

Where the toner supply relying on the density sensor is combined with the constant amount supply, the output of the density sensor becomes smaller. Meanwhile, where the toner in the developer is excessively short, it is not objectionable to supply an amount of toner larger than a proportional amount of supply. Hence, the amount of toner supply was determined as:

$$25 - V_{SG}/V_{SP}\times 10 \leqq 0 \text{ no toner supply}$$
$$> 0 \text{ toner supply by integer } n_g \text{ on omission basis.}$$

In practice, toner supply to current developing units is:

1g=13.04 sec 1794 PLS (number of pulses synchronous with drum rotation)

This may be approximated as:

$$7\times 256 \text{ PLS}=1792 \text{ PLS}=0.999 \text{ g}$$

Therefore, the amount of toner supply×(g) is expressed as:

$$x = (25 - V_{SG}/V_{SP}\times 10)\times 0.999$$
$$\simeq 25 - (V_{SG}/V_{SP}\times 10)$$

It will be seen from the above that a content of the toner register indicates an amount of toner supply. The supply of about 1 gram of toner corresponds to a time period for which 1792 pulses are counted and, thus, the time period for energizing the solenoid 42 is $\times 1792=x\times 7\times 2^8{}_8$. The microprocessor 38 therefore stores $x\times 7\times 2^8$ in a toner counter (register) 1 and a toner counter (register) 2 which are adapted to store lower 8 bits and upper 8 bits, respectively. This can be accomplished by storing "0" in all the bits of the toner counter 1 while storing binary data indicative of $x\times 7$ in the toner counter 2. After thus storing the toner supply time (count of the pulses synchronous with the drum rotation), the microprocessor 38 makes its output port $P_{20}$ logical "1", to energize the solenoid 42 and returns to the main routine (FIG. 5*b*).

Figures 2, 5B:
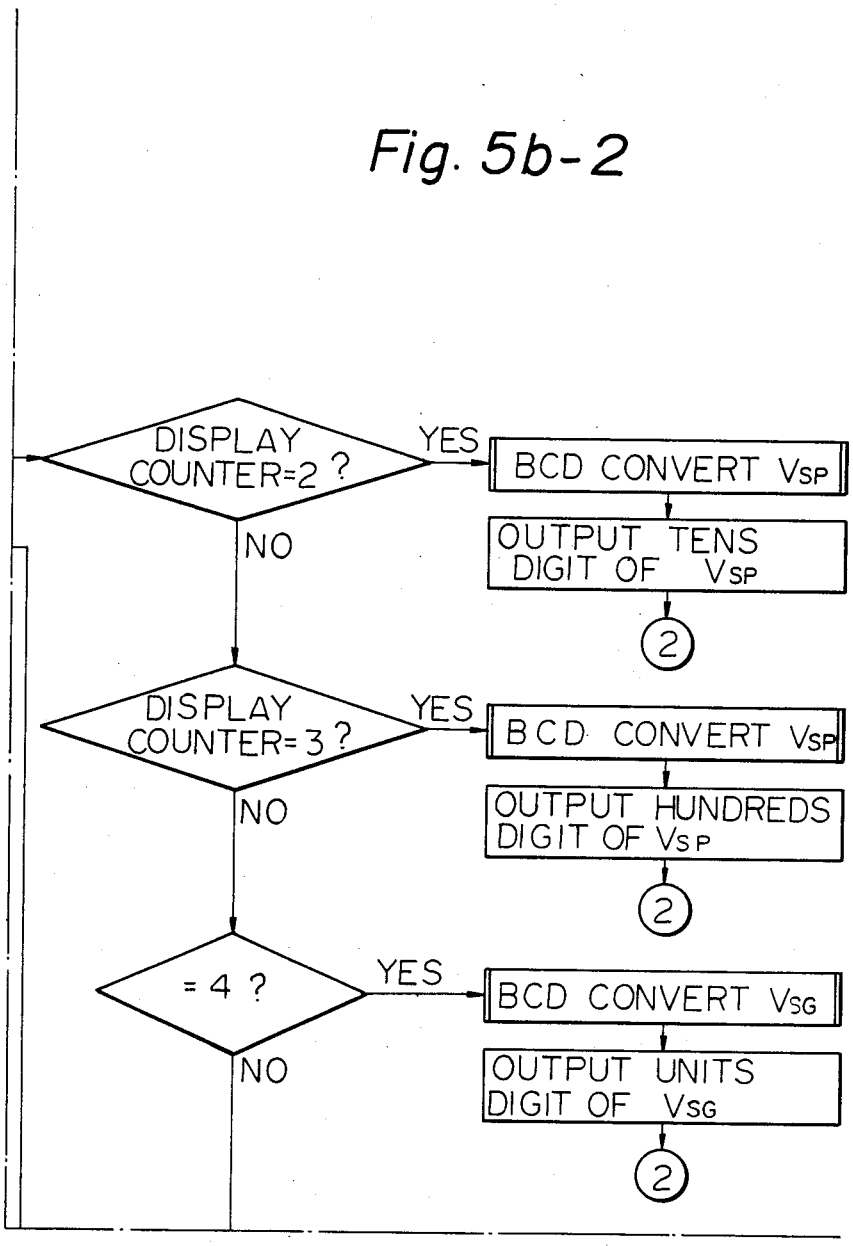
Figures 3, 5B:
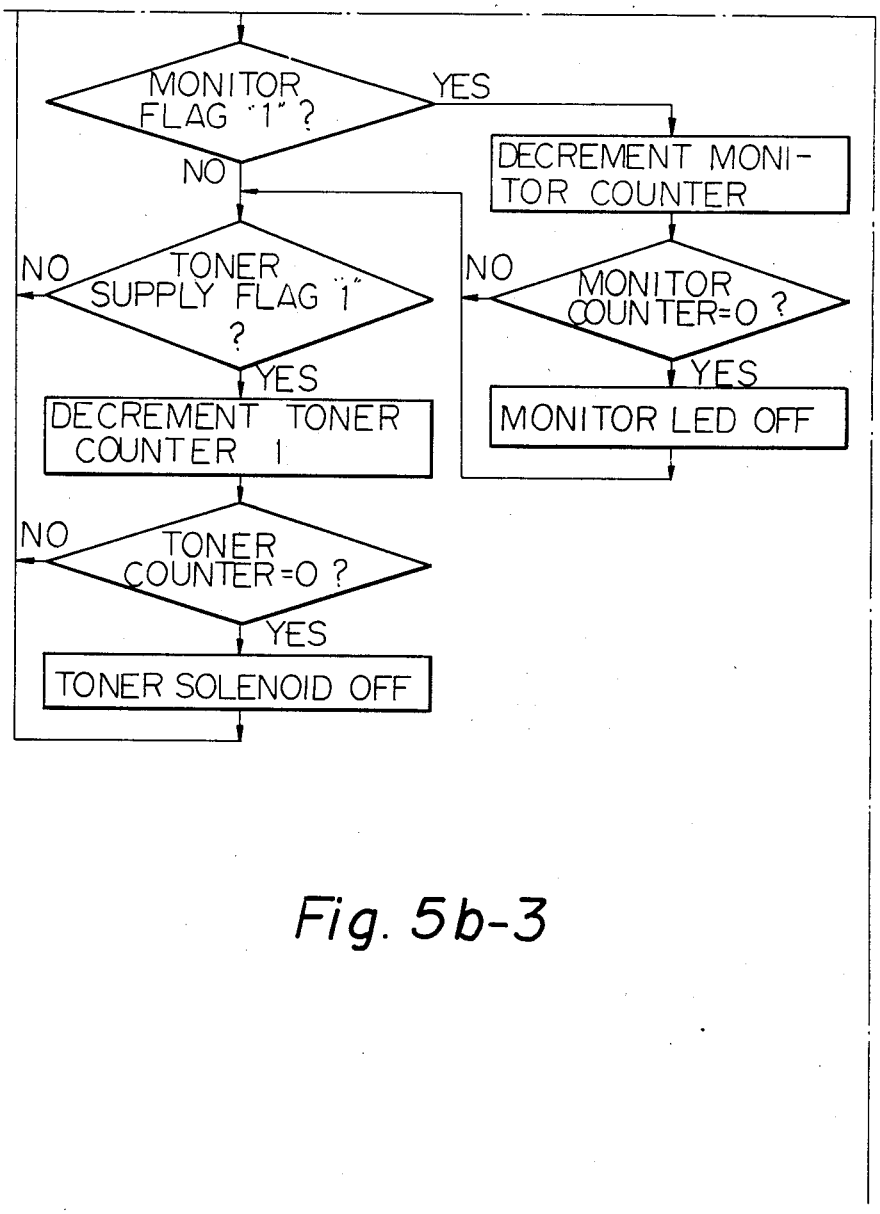
Figures 4, 5B:
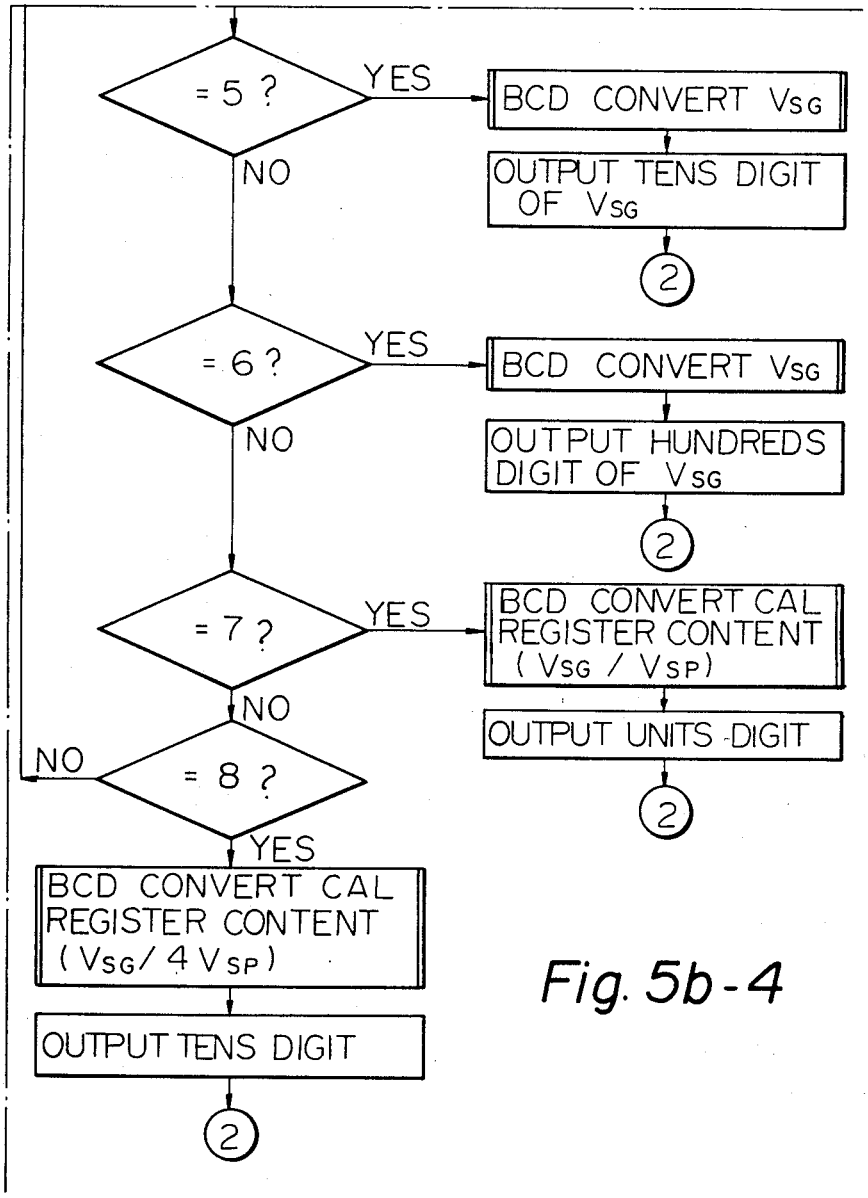

Referring to FIG. 5*b* which shows the main routine, the microprocessor 38 performs a display drive control which causes the displays $\mathbf{70_1}$–$\mathbf{70_3}$, $\mathbf{68_1}$–$\mathbf{68_3}$, $\mathbf{71_1}$ and $\mathbf{71_2}$ to emit light sequentially on a time sharing basis, as long as the signal level at the port $T_0$ (pulse synchronous with the drum rotation) remains logical "0". As the signal level at the port $T_0$ changes from logical "0" to logical "1", the microprocessor 38 increments a key counter (program counter) by "1" and energizes one display (one digit). This procedure is repeated while the signal level at the port $T_0$ remains logical "1". After $\alpha$ times of repetition, the microprocessor 38 determines that the port $T_0$ has been logical "1" for that period and a pulse synchronous with the drum rotation has arrived. Then, the microprocessor 38 sets a key end flag to logical "1" indicative of the arrival of such a pulse, decrements the monitor counter by "1" if a flag indicative of energization of the monitor LED 62 is logical "1", and deenergizes the LED 62 as the content of the monitor counter decreases to "0". As described with reference to FIG. 5*a*, when the microprocessor 38 is supplied with a toner density control command pulse from the microprocessor 52, "16" is set in the monitor counter with the LED 62 turned on and the operation advances to the main routine (FIG. 5*b*) after the procedure from the density detection to the setting of a toner supply time. For this reason and because the monitor counter is decremented in response to each drum rotation synchronous pulse in the main flow of FIG. 5*b*, the LED 62 is turned off upon generation of 16 drum rotation synchronous pulses after the completion of the interrupt procedure shown in FIG. 5*a*.

After setting the key end flag to logical "1", the microprocessor 38 refers to a toner supply flag and, if it is logical "1" indicating that the solenoid 42 has been energized, decrements the toner counter (1, 2). As the toner counter is decremented to "0", the microprocessor 38 turns off the solenoid 42. When the content of the toner counter is not "0", the microprocessor 38 waits until the signal level at the port $T_0$ becomes logical "0" while performing the display drive control for this period of time. In response to a change of the signal level at the port $T_0$ to logical "0", the microprocessor 38 clears the key end flag and key counter determining that one drum rotation synchronous pulse has terminated and, then, awaits a change of the signal level at the port $T_0$ to logical "1" while energizing the displays. In this manner, the microprocessor 38 decrements the toner counter (1, 2) every time a drum rotation synchronous pulse arrives; upon decrease of the content of the toner counter to "0", that is, upon the lapse of a toner supply time after the toner supply time has been set and the solenoid 42 has been turned on, the microprocessor 38 turns off the solenoid 42. Thereafter, the microprocessor 38 effects the display drive control only.

Figure 6:
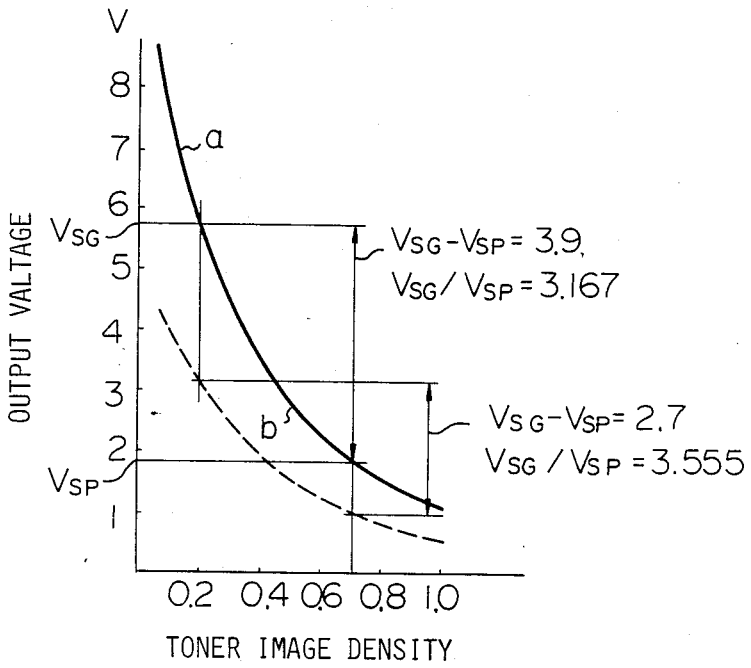
FIG. 6 is a graph showing a relationship between output voltages of a toner density sensor and toner image densities.

Thus, the embodiment described above utilizes the fact that the voltage generated by the toner image corresponding to the white mark $MR_G$ is about 4V and that generated by the toner image corresponding to the black mark $MR_P$ is about 1.7V which greatly differs from 4V, and the fact that the A/D converter 36 receives a voltage which is 2.5V at the maximum while delivering digital data which constantly indicates 2.5V as long as the input voltage is not lower than 2.5V. After detection of the toner image corresponding to the white mark $MR_G$, the operation advances to the detection of a toner density corresponding to the black mark $MR_P$ when the output data of the A/D converter 36 has indicated a voltage lower than 2.5V and such a voltage has continued throughout the subsequent m times of detection, determining that the black pattern on the drum has reached the sensor 32. This permits the pattern density detection timing to be readily set; only the read timing for the white or first pattern should be set. It is thus needless to set any another timing even if the magnification is changed. Because an amount of toner supply is determined on the basis of the density ratio $V_{SG}$ between the toner images corresponding to the white and black marks, the toner density control can occur relatively stably though the characteristics of the sensor and/or drum surface may fluctuate. As shown in FIG. 6, suppose that the output voltages of the sensor 32 sensing an image density has shifted from the standard values indicated by a solid curve to the values indicated by a dotted curve, due to a change in the characteristics of the sensor 32 and/or drum surface. Then, the difference between the voltages $V_{SG}$ and $V_{SP}$ associated with the white and black toner patterns changes from 3.9V to 2.7V, resulting in a change of $(3.9-2.7)/3.9\times 100=31\%$. Still, the ratio $V_{SG}/V_{SP}$ increases from 3.167 to 3.555 and the change is not more than $(3.555-3.167)/\mathbf{3.167}\times \mathbf{100}=\mathbf{12.3}\%$. Thus, the stability in toner density control is not effected by any change in the characteristics of the sensor and/or drum.

Furthermore, in the embodiment described, the resolution in A/D conversion of the voltage $V_{SP}$ corresponding to the black toner pattern is selected to be four times the resolution of the voltage $V_{SG}$ corresponding to the white toner pattern. As well known in the art, a developed toner image often involves white omitted spots and black spots which result in an irregular distribution of detected voltage levels though representing the same pattern. The absolute value of such fluctuation is large at $V_{SG}$ and small at $V_{SP}$. Thus, where different resolutions are assigned to different patterns and the input voltage levels for A/D conversion are made substantially the same as previously described, there can be prevented an occurrence that the fluctuation of one of the detection levels becomes predominant relative to the other. Particularly, in the case of A/D conversion, a common resolution would reduce the weight of $V_{SP}$ relative to $V_{SG}$ unless with a larger number of A/D data bits, due to the substantial range which includes $V_{SG}$ and $V_{SP}$. The number of A/D data bits should be as small as possible from the viewpoint of element construction and calculation. It will thus be apparent that assigning different resolutions to different patterns minimizes the number of A/D data bits and simplifies the element construction and calculation accordingly.

Other embodiments and modifications in accordance with the present invention will be described. While in the embodiment shown and described the white and black charge patterns have been formed by scanning the optical marks $MR_G$ and $MR_P$ carried by the glass platen 10, they may be formed through the control over energization of the charger 48, ON/OFF control of a light source for illumination, ON/OFF control of the erase lamp 50 or control of the bias voltage applied to the developing roller 24.

The value associated with an image density has been shown and described as a density of the toner image of each charge pattern (black or white). Instead, the value concerned may be achieved by detecting a surface potential of a charge pattern before development or a surface potential of a toner image of the charge pattern after development, or detecting a density of a toner image transferred onto a sheet of paper.

Furthermore, the embodiment described has been constructed to maintain image density constant by determining an amount of toner supply on the basis of a ratio between the values associated with image densities of two different patterns. Alternatively, the ratio mentioned above may be used to control the charger 48, intensity of illumination, bias voltage for development, toner supply to a developer, toner supply to the developing station or transfer potential, either independently or in combination. In any case, the value associated with an image density differs a great deal from one pattern to the other and fluctuates with time, temperature or the like. Thus, for a more stable image density control, the values corresponding to different patterns should be A/D converted with different resolutions so that the parameter associated with image densities may be controlled by an amount which is based on the ratio between the digital values.

In addition, the toner supply control based on the density ratio $V_{SG}/V_{SP}\times 10$ may be replaced by a two-level control which, for example, interrupts the toner supply when the density ratio $V_{SG}/V_{SP}\times 10$ is not less than 25 (see Table 1) and supplies a predetermined amount of toner when the density ratio is less than 25 by loading a predetermined value in the toner counter 1, 2.

Various modifications will become possible for those skilled in the art after receiving the teachings of the present disclosure without departing from the scope thereof.

What is claimed is:

1. A control method for an electrophotographic apparatus comprising the steps of:

forming first and second toner images having first and second different respective densities on a photoconductive member;

sensing the first and second densities;

dividing a first predetermined function of the first density by a second predetermined function of the second density to obtain a ratio;

comparing the ratio with a first predetermined value;

controlling a predetermined operation of the electrophotographic apparatus which affects image density in accordance with whether the ratio is above or below the first predetermined value;

the first and second toner images being formed adjacent to each other on the photoconductive member and sensed while the photoconductive member is being moved; and detecting a transition between the first and second toner images by comparing the first and second densities with a second predetermined value which is intermediate between possible ranges of the first and second densities;

the first and second predetermined functions comprising average value of the first and second densities over first and second respective predetermined lengths of time.

2. A method as claimed in claim 1, in which the predetermined operation comprises toner replenishment, the first toner image corresponding to a dark image area and the second toner image corresponding to a background image area, toner replenishment being performed when the ratio is below the first predetermined value.

3. A method as claimed in claim 1, in which the first and second toner images are formed by electrostatically charging the photoconductive member, projecting first and second light images of first and second different respective intensities onto the photoconductive member to produce first and second respective electrostatic images and developing the first and second electrostatic images with toner to produce the first and second respective toner images.

4. A method as claimed in claim 3, in which the first and second light images are optical images of first and second respective fixed members.

* * * * *